US005800327A

United States Patent [19]

Kishine et al.

[11] Patent Number: 5,800,327

[45] Date of Patent: *Sep. 1, 1998

[54] PAPER CUTTING DEVICE IN A PAPER FOLDING APPARATUS FOR A FORM PRINTING MACHINE AND PAPER CUTTING METHOD THEREIN

[75] Inventors: Toshiaki Kishine, Chiba; Hideo Izawa, Sakura; Noritaka Yamaoka, Chiba-ken; Toshikazu Yamada, Ichikawa, all of Japan

[73] Assignee: Miyakoshi Printing Machinery Co., Ltd., Narashino, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 655,703

[22] Filed: May 30, 1996

[30] Foreign Application Priority Data

Sep. 13, 1995 [JP] Japan ..... 7-235163

[51] Int. Cl.[6] ..... B65H 45/20; B26D 7/06

[52] U.S. Cl. ..... 493/357; 493/415; 83/346; 83/449

[58] Field of Search ..... 493/357, 415; 83/444, 449, 346; 225/96

[56] References Cited

U.S. PATENT DOCUMENTS

| | | | |
|---|---|---|---|
| 4,983,155 | 1/1991 | Stobb | 493/361 |
| 5,076,555 | 12/1991 | Bunch, Jr. | 493/415 |
| 5,104,366 | 4/1992 | Bunch | 493/357 |

FOREIGN PATENT DOCUMENTS

| | | |
|---|---|---|
| 0625476 A1 | 11/1994 | European Pat. Off. . |
| 5-41811 | 6/1993 | Japan . |
| 8-18750 | 2/1996 | Japan . |
| WO 93/10032 | 5/1993 | WIPO . |

*Primary Examiner*—Jack W. Lavinder
*Attorney, Agent, or Firm*—Frishauf, Holtz, Goodman, Langer & Chick

[57] ABSTRACT

A paper folding apparatus for a form printing machine includes an automatic paper cutting device having a cutting cylinder, which is disposed on an upstream side of an oscillatory shooter assembly, and which is adapted to form a cross line of cuts interposed by at least one small uncut portion in a continuous web of paper. The cutting cylinder is synchronously rotated with the paper for forming the cross line of cuts in response to a signal detected according to a predetermined length of travel of the continuous web of paper. The apparatus also includes a supporting device disposed on the oscillatory shooter assembly which supports a nozzle roller so that the nozzle roller may be moved to a first position which is displaced either toward or away from a counter roller so as to enable the continuous web of paper to slidingly travel between the two rollers, and a second position wherein the paper is intensively pressed against the counter roller so that the paper is prevented from sliding between the two rollers. The apparatus also includes an operating device which is disposed on the oscillatory shooter assembly which moves the nozzle roller supported by the supporting device from the first position to the second position when the cross line of cuts formed by the cutting cylinder arrives on the upstream side of and immediately before the nozzle roller.

14 Claims, 10 Drawing Sheets

PAPER CUTTING DEVICE IN A PAPER FOLDING APPARATUS FOR A FORM PRINTING MACHINE AND PAPER CUTTING METHOD THEREIN

FIELD OF THE INVENTION

The present invention relates to a paper cutting device in a paper folding apparatus for a form printing machine and a paper cutting method therein.

In a form printing machine, while traveling to a predetermined direction, a continuous web of paper is printed in order and perforated in a perforating section. Thereafter, in the paper folding apparatus, while traveling downwardly, the continuous web of paper is oscillatingly swung leftwards and rightwards by an oscillatory shooter assembly. Then, the continuous web of paper is folded and piled along cross perforations previously formed in the perforating section in a zigzag fashion. The folded and piled continuous web of paper is then discharged on a conveyer. Such a continuous web of paper is cut off at intervals of a predetermined number of slips defined by the successive cross perforations, for example, five hundred consecutive slips folded along the above-mentioned cross perforations, in accordance with the purpose to use and piled up, packaged and then shipped.

BACKGROUND OF THE INVENTION

It has been hitherto the practice that upon forming cross perforations on a continuous web of paper, there is counted a number of slips which are defined by the successive cross perforations and will be folded along them and there is intermittently applied a marking on the continuous web of paper at intervals of a predetermined number of the consecutive slips in a marking device. This has allowed the operator to cut the continuous web of paper with a knife or a cutting instrument on the downstream side of the paper folding apparatus, by using such a marking as the measure of the cutting.

In this connection, there is also known an automated cutting machine which is designed to be powered for a mechanical operation so as to automatically cut the continuous web of paper in conjunction with a mark sensor which detects the above-mentioned marking.

Furthermore, a conventional paper cutting device has also been known, which is designed to tear the continuous web of paper along a given cross perforation on the upstream side of an oscillatory shooter. Such a device is shown in FIG. 1 of the accompanying drawings.

As shown, on the upstream side of the oscillatory shooter a, this known device includes a pressing roller pair A which comprises a rotating roller b that is rotated at a speed of rotation as commensurate with a speed of travel of the continuous web of paper and a movable roller d that is capable of being displaced towards and away from the rotating roller b by means of a solenoid c and a tearing roller pair B which comprises a rotating roller e that is rotated at a peripheral speed of rotation that is faster than the speed of travel of the continuous web of paper and a movable roller g that is capable of being displaced towards and away from the rotating roller e by means of a solenoid f. By actuating both solenoids c and f in response to an operating signal that is furnished from a marking sensor (not shown), the respective movable rollers d and g of the both roller pairs A and B will be brought into contact with the rotating rollers b and e thereof, respectively. Since there is a difference in the speed of rotation between the respective rotating rollers b and e of the two roller pairs A and B, the continuous web of paper will be torn at the cross perforation that lies between the two roller pairs A and B. Character h represents a nozzle roller which is rotated at a speed of rotation that is faster than the speed travel of the continuous web of paper.

Having described various sorts of the related conventional techniques, it will be apparent that it is time consuming and laborious for the operator to visually locate a multiplicity of markings on a continuous web paper and then to be made to engage in cutting the continuous web of paper at each of the markings located. And, this procedure is evidently poor in productivity.

Also, regarding a device with a cutter that is automatically powered for the required mechanical operation, though it is certainly more efficient than the one which relies upon a manual operation, every time a cutting is effected by the powered cutter, it does need to insert a paper receiving table for receiving the succeeding continuous web paper on the upstream side where the cutting is effected. Therefore, there will arise such problems as follows. Since the mechanism of operating the cutter and the mechanism of operating the paper receiving table become unavoidably complicated, the above-mentioned device will be large-sized and yet considerably expensive. Further, since the step of operation required for cutting is made extensive there, there is a practical inadequacy in cutting at intervals of a small number of folds of paper.

It may be further noted that a tearing and cutting device as shown in FIG. 1 also has a significant problem. Since a continuous web of paper is cut on the far upstream side of the nozzle roller h of the oscillatory shooter a, there remains a considerably long sheet of paper from the nozzle roller h to the cut end of the paper, which is, so called, a free end portion of the continuous web of paper. Therefore, while being subjected to a swinging motion by the oscillatory shooter a, this long free end portion is forced to be fed by the nozzle roller faster than before the cutting is performed. As a result, the timing is disturbed at which this portion of the continuous web paper is folded, and thus a jam occurs in the portion of a pair of screws i where it is to be folded and piled regularly.

SUMMARY OF THE INVENTION

With the foregoing taken into account, it is an important object of the present invention, in a paper folding apparatus for a form printing machine, to enable a continuous web of paper which has traveled from the form printing machine to be cut automatically at intervals of a predetermined length thereof, that is, at intervals of a predetermined number of folds of consecutive slips defined by successive cross perforations, in a manner such that a processing or handling operation after folding the continuous web of paper may be simplified, expedited and facilitated, thereby enhancing the productivity of the entire system.

It is a concomitant object of the present invention to allow the cutting of a continuous web of paper to be effected on the upstream side of and immediately before a nozzle roller that is rotated at a peripheral speed of rotation that is faster than a speed of travel of the continuous web of paper.

It is another concomitant object of the present invention to effectively eliminate a "free end portion" which is an upstream part of a cut portion of the continuous web of paper towards the osillatory shooter assembly.

It is a further concomitant object of the present invention to prevent the occurrence of a jam in the upstream part of the cut portion of the continuous web of paper when it is folded.

It is a still further object of the present invention to allow a continuous web paper to be smoothly guided even at the position where the continuous web of paper is preliminarily cut by means of a full edge type cutter and thus to permit it to travel without any trouble at this position.

In order to achieve the above-mentioned objects, there is provided in accordance with the present invention, in a first aspect thereof, a paper folding apparatus for a form printing machine, which comprises: a paper traveling path for permitting a continuous web paper to travel at a certain speed of travel, the continuous web paper having a succession of cross perforations which have been formed at predetermined intervals in a perforating section; and an oscillatory shooter assembly having at a downward end thereof a counter roller and a nozzle roller which is adapted to be rotationally driven with a peripheral speed thereof being faster than a speed of travel of the continuous web paper, the oscillatory shooter assembly having the continuous web paper passed between both of the rollers and being adapted to be oscillatingly swung leftwards and rightwards so that the continuous web paper may be folded by an oscillatory motion of the oscillatory shooter assembly along the successive cross perforations in a zigzag fashion, and which is characterized in that a paper cutting device in the paper folding apparatus for the form printing machine, comprises: means for forming a cross line of cuts interposed by at least one small uncut portion in the continuous web paper, the means for forming the cross line of cuts being disposed on the upstream side of the oscillatory shooter assembly; and means for cutting the continuous web paper, the means for cutting the paper being disposed on the oscillatory shooter assembly.

Preferably, the means for forming the cross line of cuts is a cutting cylinder which is provided with a full edge type cutter that is slightly protruded and is adapted to form the cross line of cuts interposed by at least one small uncut portion in the continuous web paper, and which is adapted to be rotated synchronously with a traveling speed of the continuous web paper for performing an operation for forming the cross line of cuts in response to a signal detected according to a predetermined length of travel of the continuous web paper.

It is preferred that the means for cutting the continuous web paper comprises a supporting device for supporting the nozzle roller and an operating device for moving the nozzle roller, the supporting device being adapted to support the nozzle roller so that the nozzle roller may be displaced towards and away from the counter roller, that is, the nozzle roller may be moved between a first position at which it is lightly pressed against the counter roller under such a pressing force as to enable the continuous web paper to slidingly travel between the two roller and a second position at which it is a little intensively pressed against the counter roller so that the continuous web paper may be incapable to slide between the two roller means; and the operating device being adapted to move the nozzle roller supported by the supporting device from the first position to the second position when the cross line of cuts formed by the cutting cylinder arrives on the upstream side of and immediately before the nozzle roller.

Preferably, the full edge type cutter on the cutting cylinder is adapted to apply the cross line of cuts onto and along the cross perforation formed previously on the continuous web paper in the perforating section.

It is further preferred that there is provided at least one recess in an edge of the full edge type cutter which is slightly protruded beyond said cutting cylinder and is securely fixed to the cutting cylinder in order to leave at least one small uncut portion in the cross line of cuts on the continuous web paper.

It is still further preferred that there is provided a wire type paper guiding device within the position corresponding to the recess portion and also between the cutting cylinder and a impression cylinder both of which are facing each other in order to guide the continuous web paper passing between the two cylinders.

The present invention further provides, in a second aspect thereof, a paper cutting method in a paper folding apparatus for a form printing machine, which comprises the steps of: providing, in the paper folding apparatus, a paper traveling path for permitting a continuous web paper to travel at a certain speed of travel, the continuous web paper having a succession of cross perforations which have been formed at predetermined intervals in a perforating section; providing, in the paper folding apparatus, an oscillatory shooter assembly having at a downward end thereof a counter roller and a nozzle roller; rotationally driving the nozzle roller with a peripheral speed thereof being faster than a speed of travel of the continuous web paper; passing the continuous web paper between both of the rollers while being oscillatingly swung leftwards and rightwards so that the continuous web paper may be folded by an oscillatory motion of the oscillatory shooter assembly along the successive cross perforations in a zigzag fashion; disposing, on the upstream side of the oscillaroty shooter assembly, means for forming a cross line of cuts interposed by at least one small uncut portion in the continuous web paper; and disposing, on the oscillatory shooter assembly, means for cutting the continuous web paper.

Preferably, the method further comprises the steps of disposing, on the upstream side of the oscillatory shooter assembly, as the means for forming the cross line of cuts, a cutting cylinder which is provided with a full edge type cutter that is slightly protruded and is adapted to form the cross line of cuts interposed by at least one small uncut portion in the continuous web paper; rotating the cutting cylinder synchronously with a traveling speed of the continuous web paper; and automatically performing an operation for forming the cross line of cuts in response to a signal detected according to a predetermined length of travel of the continuous web paper.

It is preferred that the method further comprises the steps of disposing, on the oscillatory shooter assembly, as the means for cutting the continuous web paper, a supporting device for supporting the nozzle roller and an operating device for moving the nozzle roller; supporting the nozzle roller so that the nozzle roller may be displaced towards and away from the counter roller, that is, the nozzle roller may be moved between a first position at which it is lightly pressed against the counter roller under such a pressing force as to enable the continuous web paper to slidingly travel between the two rollers and a second position at which it is a little intensively pressed against the counter roller so that the continuous web paper may be incapable to slide between the two rollers; and performing an operation for moving said nozzle roller supported by the supporting device from the first position to the second position when the cross line of cuts formed by the cutting cylinder arrives on the upstream side of and immediately before the nozzle roller, thereby cutting the continuous web paper along the cross line of cuts; and subsequent to the preceding step, performing an operation for moving the nozzle roller to the first position.

Preferably, the cross line of cuts is applied onto and along the cross perforation formed previously on the continuous web paper in the perforating section.

It is preferred that the method further comprises the step of leaving at least one small uncut portion in the cross line of cuts on the continuous web paper by providing an edge of the full edge type cutter with at least one recess.

Preferably, the method further comprises the step of guiding the continuous web paper passing between the two cylinders by providing a wire type guiding device within the position corresponding to the recess portion and also between the cutting cylinder and a impression cylinder both of which are facing each other.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

DESCRIPTION OF PREFERRED EMBODIMENTS

One embodiment according to the present invention will be described in detail below with reference to the accompanying FIG. 2.

Figure 1:
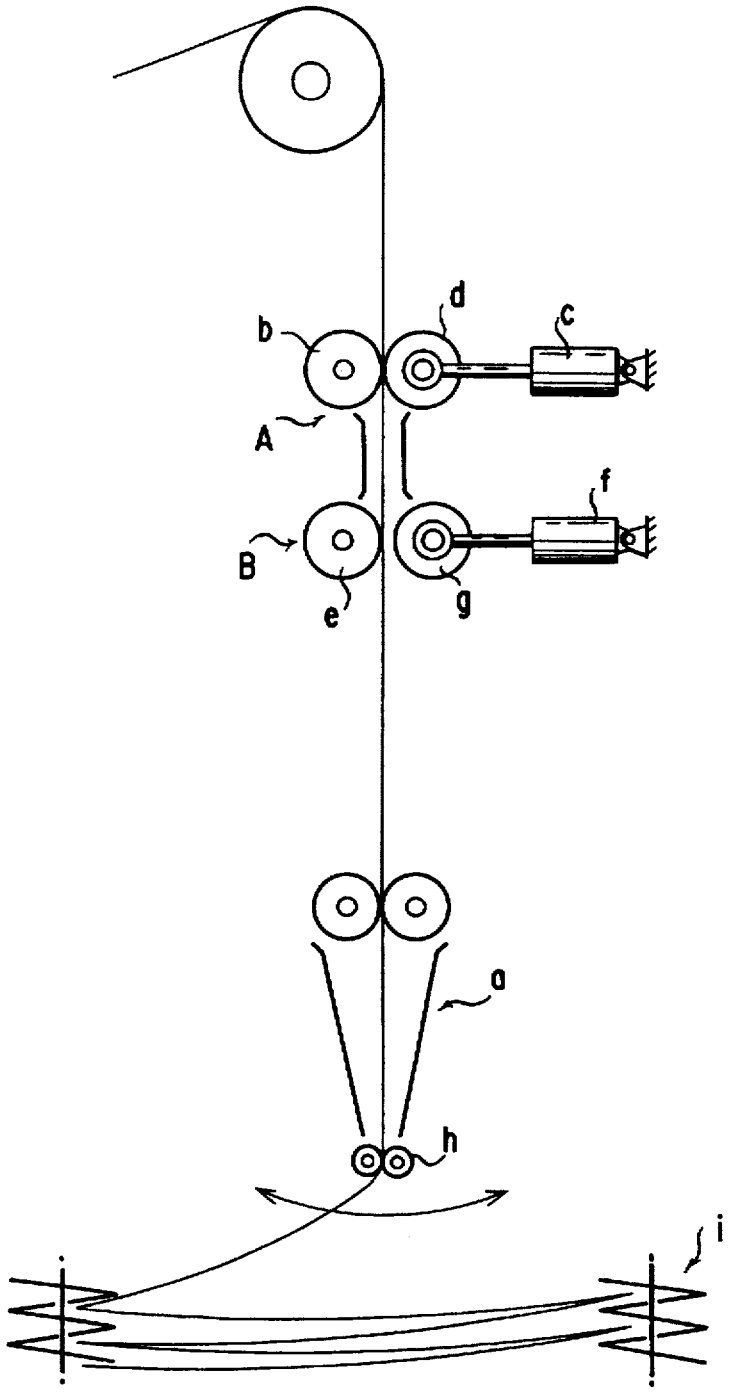
FIG. 1 is a constructive view diagrammatically illustrating an essential part of a typical related device in the prior art.
Figure 2:
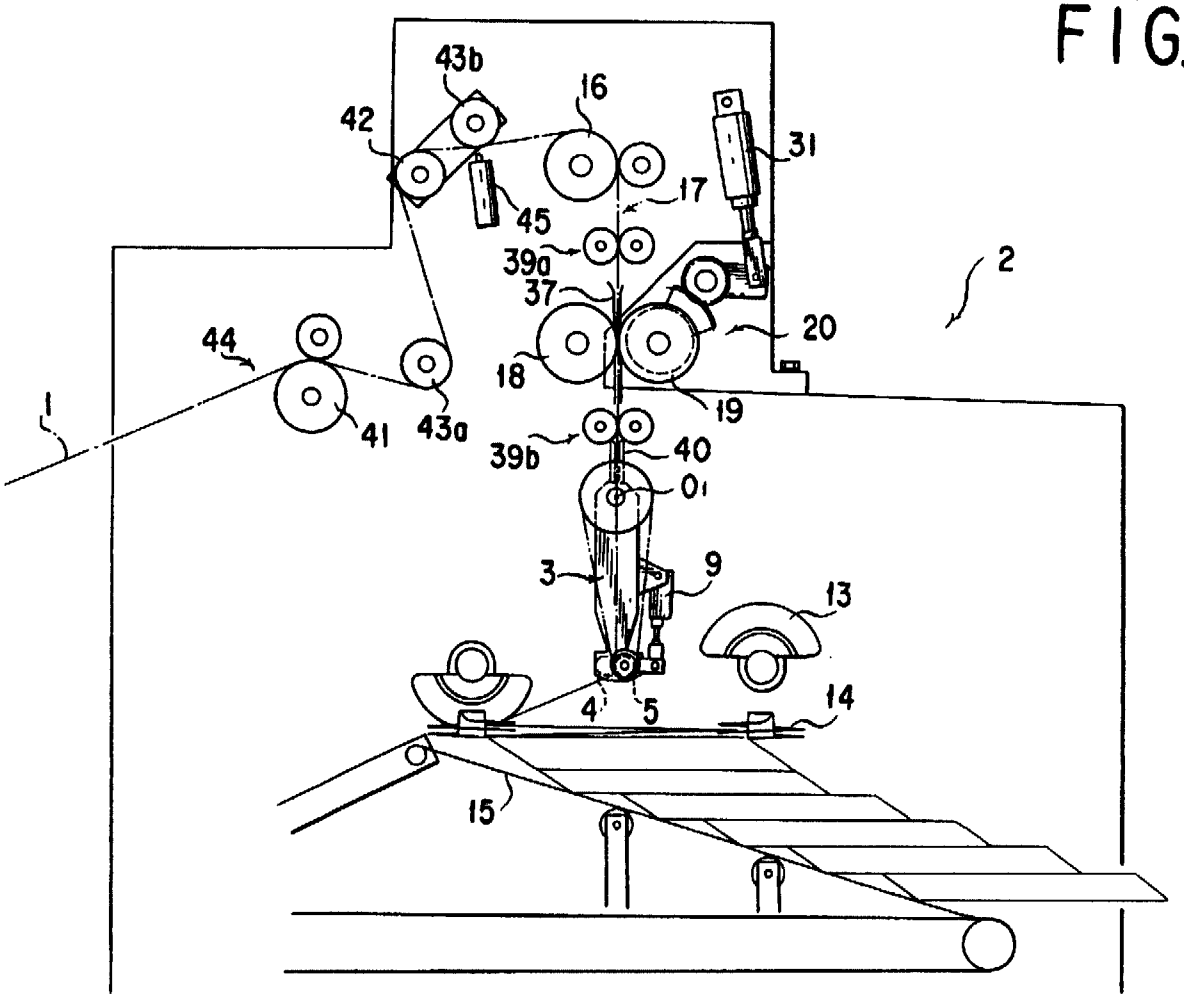
FIG. 2 is a constructive view diagrammatically illustrating an essential part of one embodiment according to the present invention.

FIG. 2 shows the principal part of an entire construction of a paper folding apparatus according to the present invention. In the Figure, numeral 1 designates a continuous web of paper which has been previously printed in a printing section (not shown) and in which a series of cross or transverse perforations has been then made by a perforator device (not shown) at predetermined intervals in the longitudinal direction. Note further that on this continuous web of paper 1, there have been also previously applied marks as an aid for cutting by a marking device (not shown). Each mark is applied at intervals of a predetermined number of consecutive slips, each of which is defined between two successive cross perforations on the paper. Numeral 2 designates a paper folding apparatus, in which the continuous web of paper 1 is folded along cross perforations.

Figure 3:
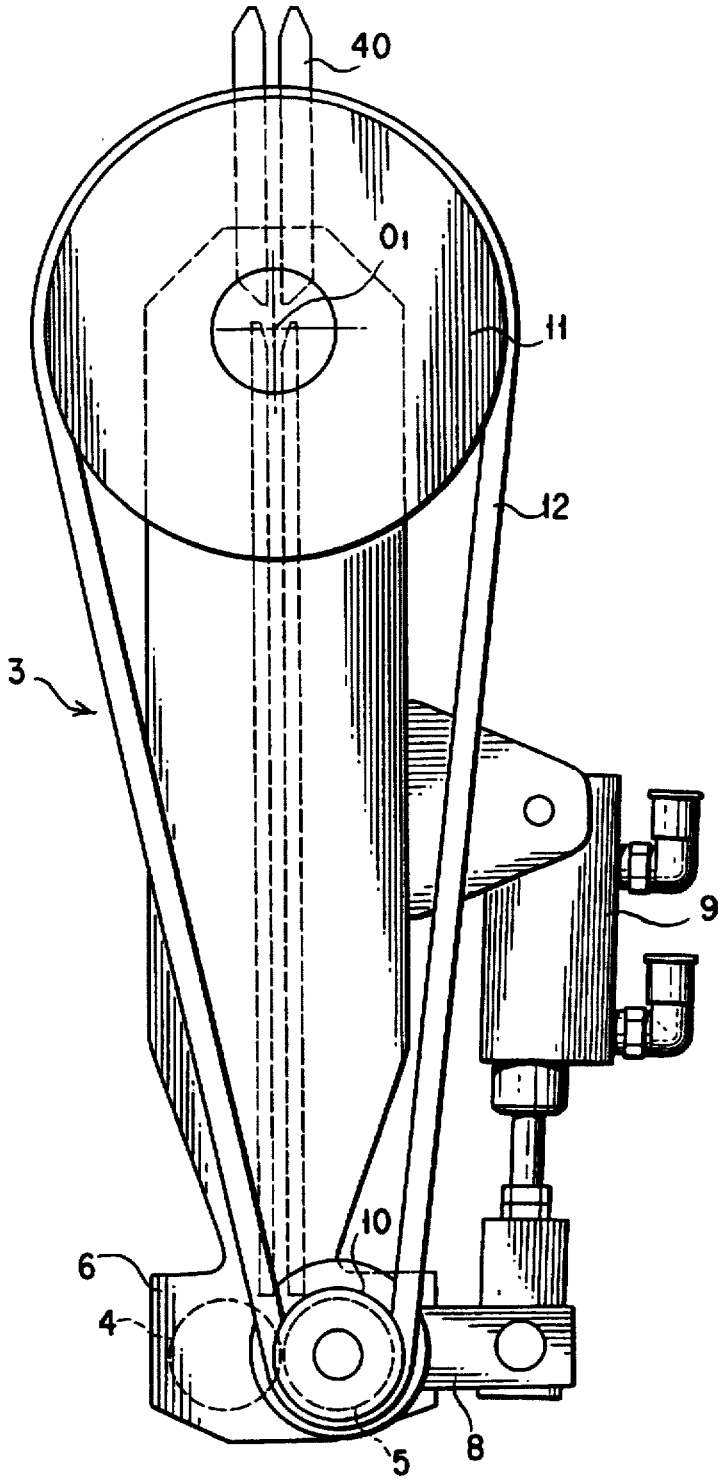
FIG. 3 is a front view illustrating an oscillatory shooter assembly that may be used in the above-mentioned embodiment.

In the paper folding apparatus 2, an explanation will first be given with respect to an oscillatory shooter assembly 3. As shown in FIG. 3 in greater detail, the oscillatory shooter assembly 3 is so constructed as to be oscillated in a vertical plane just like a pendulum swung leftwards and rightwards about a center of oscillation $O_1$ by means of an oscillating unit (not shown). The oscillatory shooter assembly 3 has at its lower end a counter roller 4 and a nozzle roller 5 which are facing each other.

Figure 4:
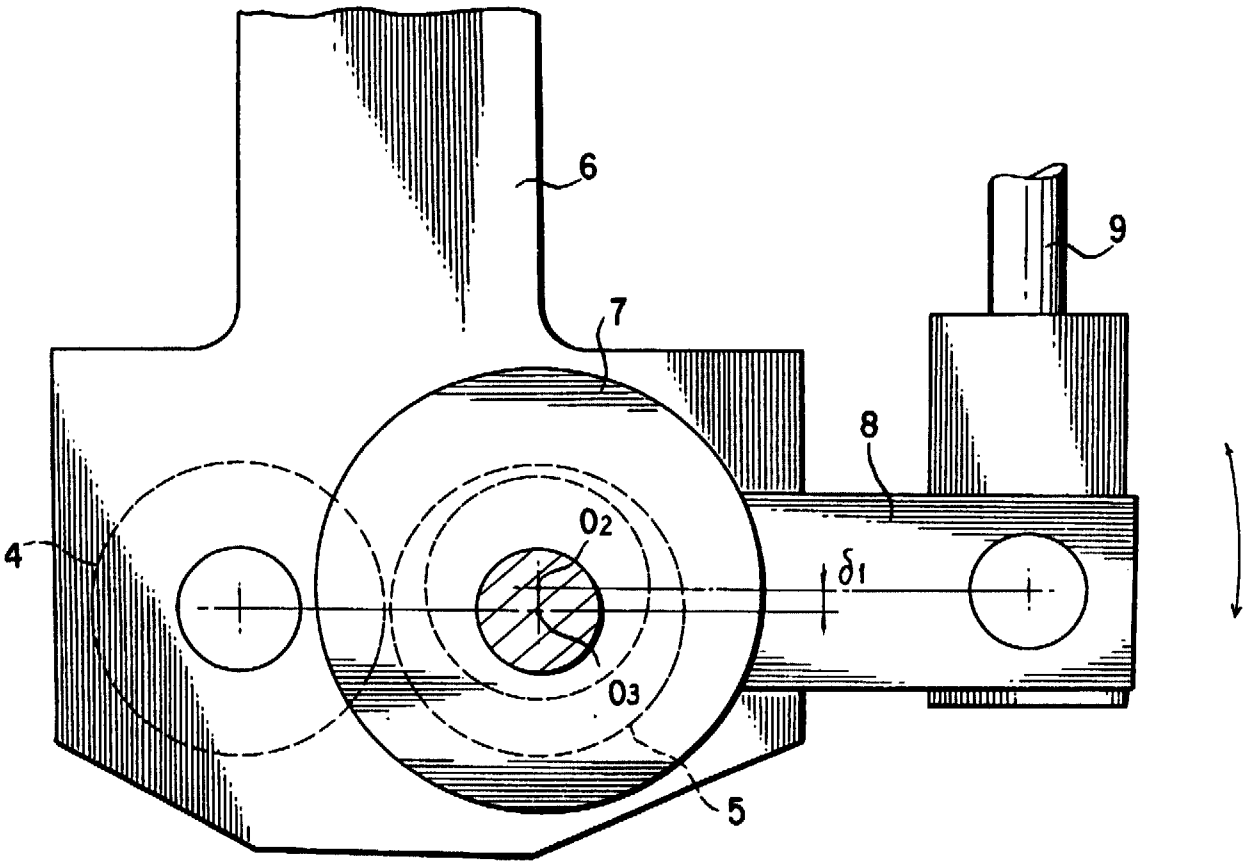
FIG. 4 is a constructive view diagrammatically illustrating a portion of a nozzle roller that may be used in the above-mentioned embodiment.
Figure 5:
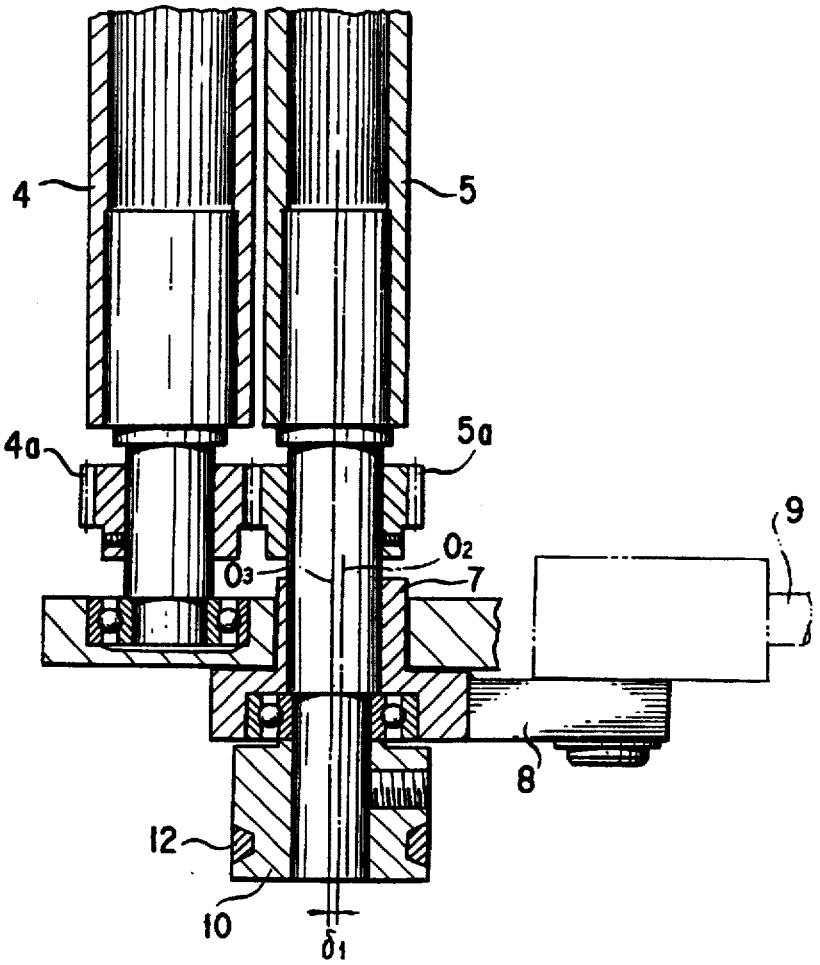
FIG. 5 is a cross sectional view illustrating a construction of the nozzle roller portion that may be implemented in the above-mentioned embodiment.

A lower portion of the oscillatory shooter assembly 3 including the nozzle roller 5 is constructed as shown in FIGS. 4 and 5. The counter roller 4 is supported by a shooter frame 6. On the other hand, the nozzle roller 5 is supported by the shooter frame 6 via a bearing box 7 which is rotatably supported by the shooter frame 6. A center of rotation $O_2$ of the bearing box 7 with respect to the shooter frame 6 is made eccentric in a slight amount of eccentricity $\delta_1$, for example, about 1 mm with a center of a bearing which is included in the bearing box 7, that is, with a center of rotation $O_3$ of the nozzle roller 5.

An arm 8 is provided on the above-mentioned bearing box 7 and an operating cylinder 9 is coupled to the arm 8. By expandingly or contractively operating the operating cylinder 9, the bearing box 7 will be rotated and thus, the nozzle roller 5 can be displaced towards or away from the counter roller 4 by the above-mentioned slight amount of eccentricity $\delta_1$. More specifically, when the operating cylinder 9 is contractively operated, a first position will be established, at which the nozzle roller 5 is moved away from the counter roller 4 by a small distance, which, for example, is smaller than the thickness of the continuous web paper 1. Conversely, when the operating cylinder 9 is expandingly operated, a second position will be established, at which the nozzle roller 5 is brought into an intensive contact with the counter roller 4.

A follower pulley 10 is securely fixed to the one end of the nozzle roller 5. The follower pulley 10, as shown in FIG. 3, is coupled via a belt 12 with a drive pulley 11 which is mounted coaxially with the center of oscillation $O_1$ of the oscillatory shooter assembly 3. The drive pulley 11 is in turn coupled to a power shaft of the paper folding appartus 2 via a coupling unit (not shown). By way of a rotation of the drive pulley 11, the above-mentioned nozzle roller 5 is so constructed that it may be rotationally driven at a peripheral speed that is faster than the speed of travel of the continuous web of paper 1.

The counter roller 4 and the nozzle roller 5 which are mentioned above are so coupled together via gears 4*a* and 5*a* that they may be rotated at an identical peripheral speed in the direction of travel of the continuous web of paper 1. It will be seen here that for the reason of an eccentric operation of the nozzle roller 5 as mentioned above, there will be changed the state in which the gears 4*a* and 5*a* are engaged with each other. However, such a change would pose no particular problem because it is extremely small.

At both of the right hand and left hand sides of the oscillatory shooter assembly 3, there are disposed a pair of beaters 13, 13 as well as a pair of screws 14, 14. In the same manner as the prior art, the beaters and the screws are so constructed that they may be operated synchronously with the oscillatingly motion of the oscillatory shooter assembly 3 and thereby, the continuous web of paper 1 discharged from the oscillatory shooter assembly 3 may be folded in a zigzag fashion. A conveyer 15 conveys the continuous web of paper which is discharged and folded as mentioned previously.

On the upstream side of the oscillatory shooter assembly 3, there is provided a paper cutting path 17 which vertically extends from the oscillatory shooter assembly 3 to a pull roller 16. The vertically traveling continuous web of paper 1 may acquire a cross or transverse line of cuts in the paper cutting path 17. This paper cutting path is provided with a cutting cylinder device 20 which comprises a impression cylinder 18 and a cutting cylinder 19 which are facing each other with the paper cutting path 17 between them.

Figure 6:
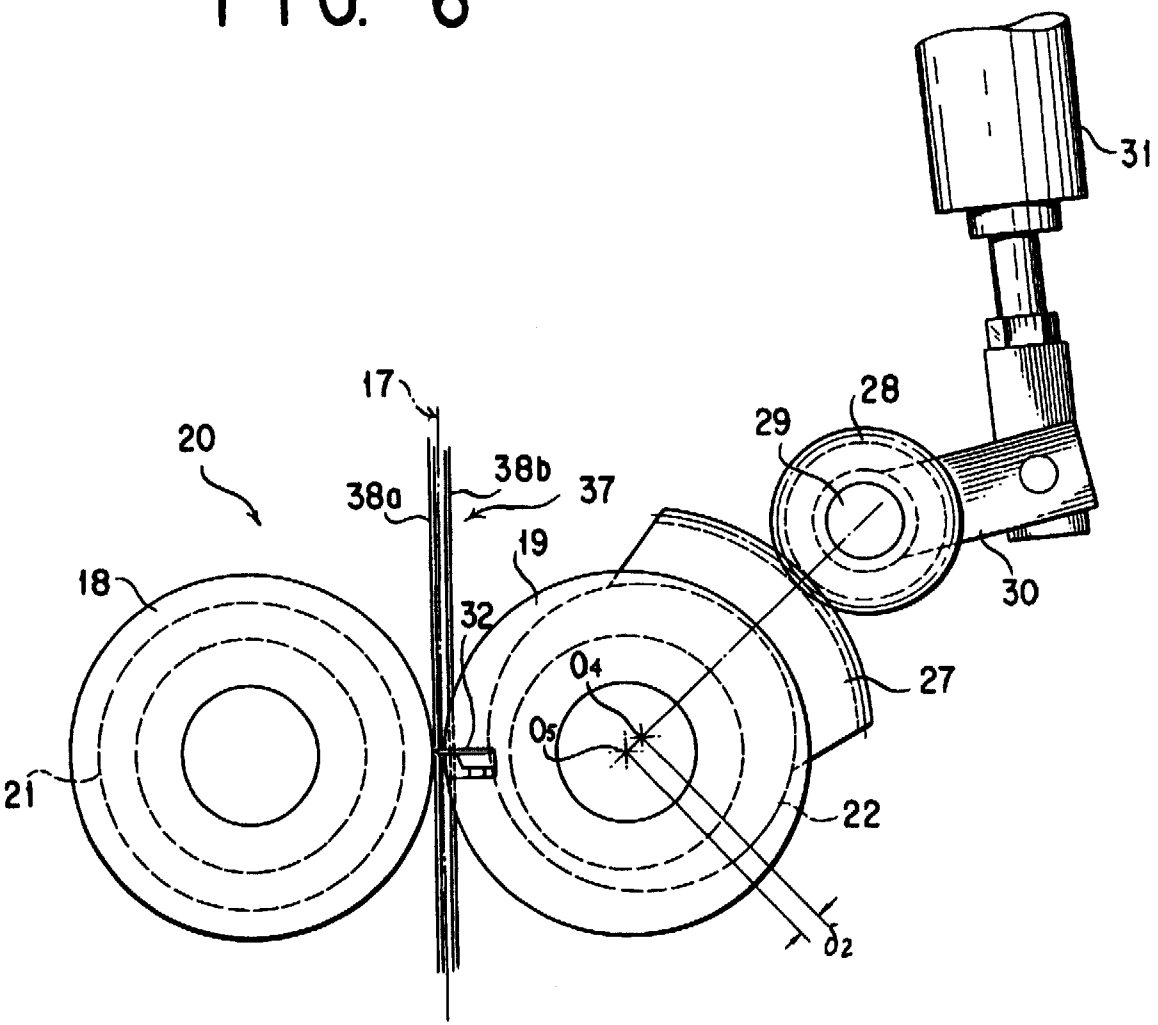
FIG. 6 is a constructive view diagrammatically illustrating a portion of a cutting cylinder device that may be used in the above-mentioned embodiment.
Figure 7:
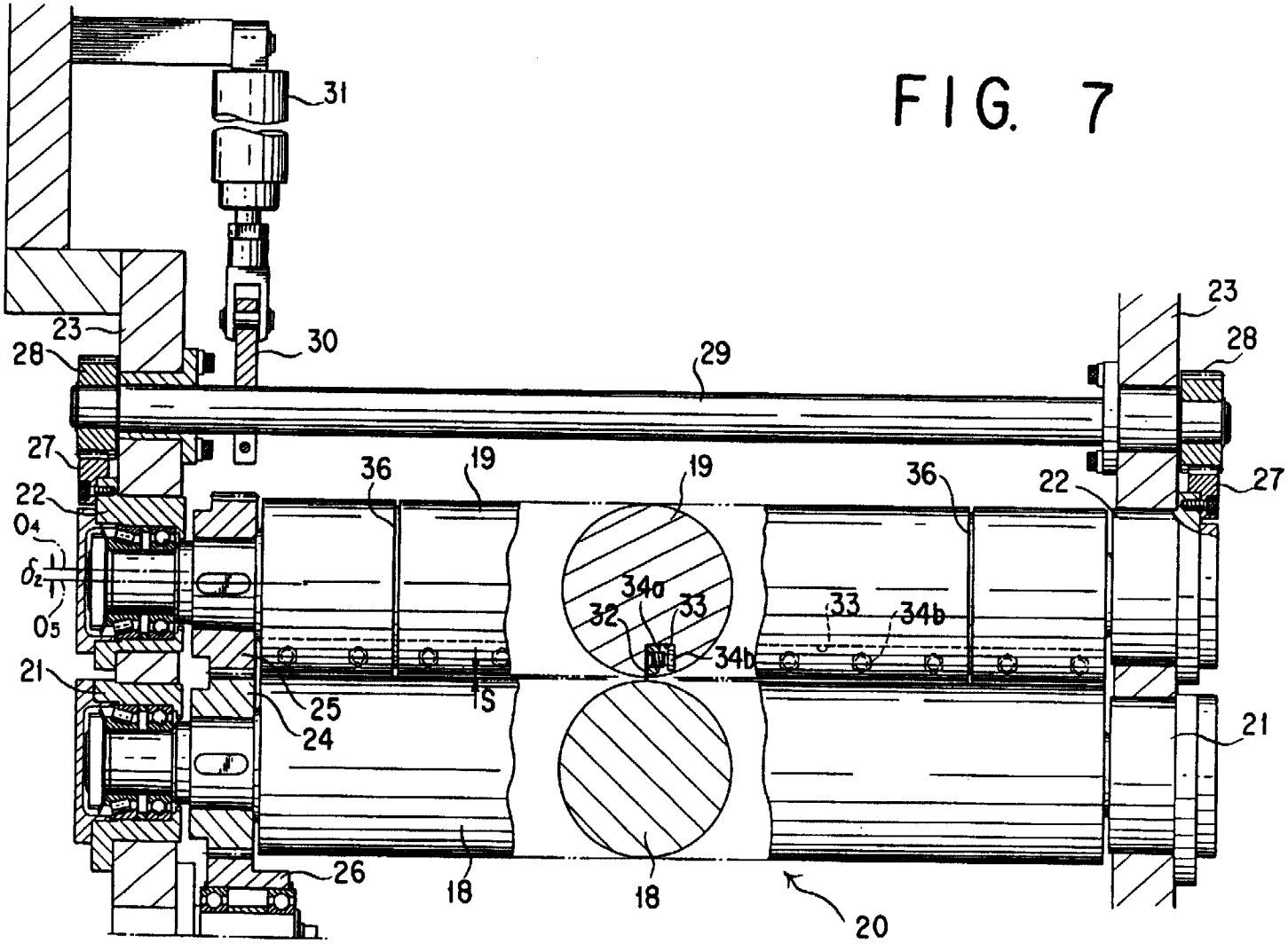
FIG. 7 is a cross sectional view illustrating a construction of the cutting cylinder device that may be implemented in the above-mentioned embodiment.

FIGS. 6 and 7 show a detailed construction of the cutting cylinder device 20. As will be better seen in FIG. 7, both ends of the impression cylinder 18 are rotatably supported by front and rear frames 23 via a pair of bearing boxes 21 which include respective bearings. In the same manner, both ends of the cutting cylinder 19 are rotatably supported by the front and rear frames 23 via a pair of bearing boxes 22 which include respective bearings.

Both the cylinders 18 and 19 are identical in their diameter in this particular embodiment. Gears 24 and 25 are securely fixed to the respective cylinders 18 and 19, and are meshed with each other. The gear 24 on the side of the impression cylinder 18 is also meshed with a drive gear 26 so that by means of the drive gear 26, the impression cylinder 18 and the cutting cylinder 19 may be rotated via both of the gears 24 and 25 at an identical speed of rotation in the direction of the travel of the continuous web paper 1.

The above-mentioned bearing boxes 21 for the impression cylinder 18 are securely fixed to the front and rear frames 23 whereas the bearing boxes 22 for the cutting cylinder 19 are rotatably supported by the front and rear frames 23. It should be noted here that a center of rotation $O_4$ of the bearing box 22 with respect to the frame 23 is made eccentric in an amount of eccentricity $\delta_2$ with a center of rotation $O_5$ of the cutting cylinder 19.

A pair of segment gears 27 are securely fixed to the bearing boxes 22 for the cutting cylinder 19. The center of rotation $O_4$ of the bearing boxes 22 corresponds to a center of an axis of the segment gears 27 which are meshed with a pair of operating gears 28, respectively. An arm 30 is securely fixed to a shaft 29 extending between the operating gears 28, and an operating cylinder 31 is coupled to the arm 30.

By expandingly or contractively operating the operating cylinder 31, the arm 30 is swung and thereby, the bearing boxes 22 are eccentrically rotated with respect to the center of rotation $O_5$ of the cutting cylinder 19 via the operating gears 28 and the segment gears 27. Accordingly, the cutting cylinder 19 can be displaced towards and away from the impression cylinder 18. Then, there will be brought about a change in the distance between the axes of the impression cylinder 18 and the cutting cylinder 19. However, since such a change is extremely small, the engagement between the gears 24 and 25 which are meshed with each other will in no way adversely influence on the rotary movement here of interest.

On the periphery of the cutting cylinder 19, a full edge type cutter 32 which extends over the overall length of the cutting cylinder 19 in its longitudinal directtion is fitted in a groove 33 which is arranged in the cutting cylinder 19 and extends over the overall length thereof in its longitudinal direction. By being securely pressed and fixed with a plurality of push plates 34*a* and push bolts 34*b*, the full edge type cutter 32 is securely fastened to the cutting cylinder 19 as shown in FIG. 7. The full edge type cutter 32 is slightly protruded beyond the cutting cylinder 19 by the distance which is equal to the clearance S between the impression cylinder 18 and the cutting cylinder 19.

Figure 8:
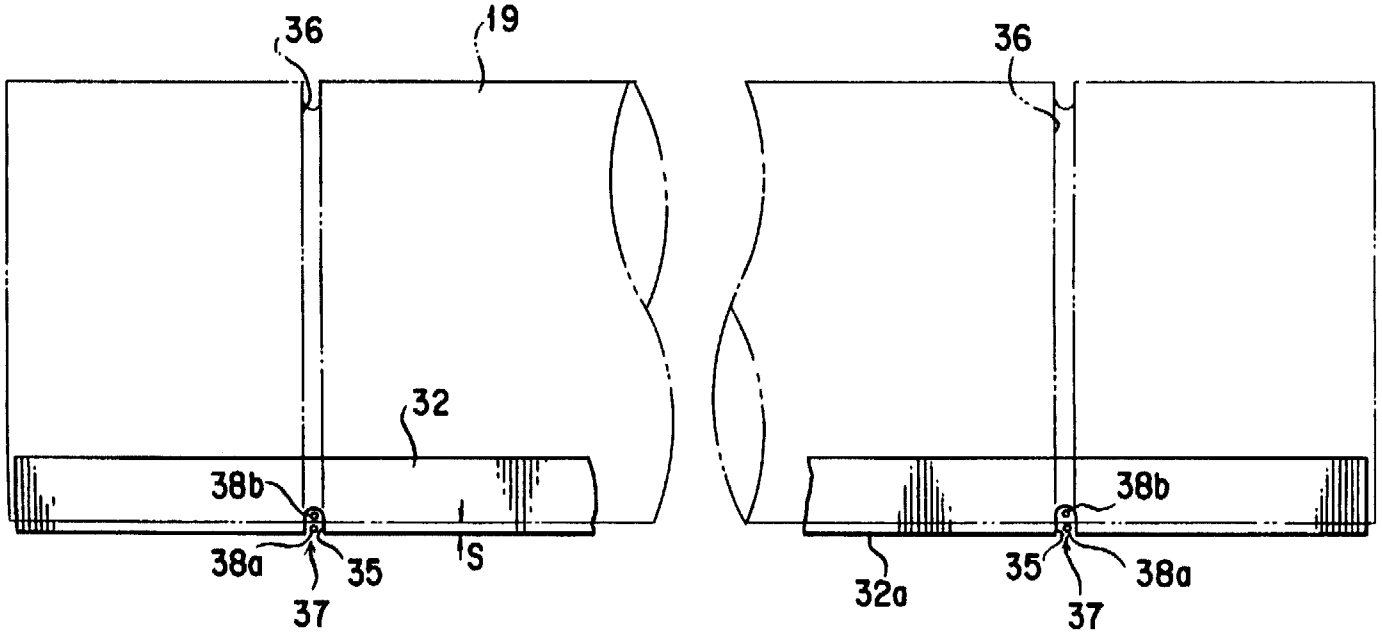
FIG. 8 is a top plan view illustrating a portion of a full edge type cutter that may be used in the above-mentioned embodiment.

The full edge type cutter 32 that is described above should be preferably constructed as specifically shown in FIG. 8. In this embodiment, the full edge type cutter 32 is provided with an edge 32*a* which extends over the overall length of the full edge type cutter. The edge 32*a* is provided with, for example, two recesses 35 therein. A depth of each recess 35 is greater than the length of the above-mentioned protrusion beyond the cutting cylinder 19 or the clearance S. Further, there is provided with a circular grooves 36 on the periphery of the cutting cylinder 19 at the position which corresponds to each of the recesses 35 of the full edge type cutter 32.

There is provided a paper guiding device 37 in the cutting cylinder device 20 which is disposed in the above-mentioned vertical paper cutting path 17, as shown in FIG. 2.

The paper guiding device 37 guides the continuous web of paper 1 which passes through the paper cutting path 17. More in detail, as shown in FIGS. 6 and 8, the paper guiding device 37 comprises a pair of vertical guide wires 38*a* and 38*b* which are juxtaposed with each other across the paper cutting path 17 and which are disposed within each recess 35 of the full edge type cutter 32.

As shown in FIG. 2, on the upstream and downstream sides of the above-mentioned cutting cylinder device 20 in the paper cutting path 17, there are disposed a pair of guide rollers 39*a* and a pair of guide rollers 39*b*, respectively. Also, there is provided a paper guiding device 40 between the guide rollers 39*b* and the oscillatory shooter assembly 3, both of which are disposed on the downstream side of the cutting cylinder device 20. The paper guiding device 40 comprises a pair of plates which face each other.

On the upstream side of the paper cutting path 17, there is provided a preliminary paper guiding path 44, where there are disposed pull rollers 16 and 41, a compensation roller 42 and guide rollers 43*a* and 43*b*. Further, there is provided a mark sensor 45 which is arranged opposite the guide roller 43*b* which is disposed between the compensation roller 42 and the pull roller 16 in the preliminary paper guiding path 44.

With regard to the cutting cylinder device 20, the diameter of the above-mentioned cutting cylinder 19 is determined depending upon a preset pitch of a series of cross or transverse perforations preliminary formed on the continuous web of paper 1 that is entered into the paper folding apparatus 2. More specifically, the diameter of the cutting cylinder 19 is so determined that the peripheral length of the cutting cylinder may be identical with such a pitch of cross perforations or a distance between two successive predetermined cross perforations. The phase of rotation of the cutting cylinder 19 is determined so that when a given cross perforation on the continuous web of paper 1 is entered between the two cylinders 18 and 19, the full edge type cutter 32 may be brought into contact with that cross perforaton and a cross or transverse line of cuts therealong may be formed by the edge 32*a*.

In case the pitch of the above-mentioned perforations is altered, the cutting cylinder 19 is exchanged so that the length of its periphery may be identical with the altered pitch of cross perforations. In order to easily exchange the cutting cylinder, there are prepared a plurality of cutting cylinders 19 which have different diameters and are designed to be cassette-type ones with respect to the frame of the paper folding apparatus 2. Accordingly, there can be substituted a frame with one cassette, which supports both ends of the cutting cylinder 19, for a different frame with another cassette.

In connection with the above, it should be noted that there is an exception. The position at which the continuous web of paper 1 is cut by the full edge type cutter 32 does not always coincide with the position of a cross perforation. Under certain circumstances, it is all right that the position where the continuous web of paper 1 is cut by the full edge type cutter 32 is situated midway between two successive cross perforations.

In further connection with the above, it should be also noted that the operations of various operating parts which are required for permitting the continuous web of paper 1 to travel in the embodiment according to the present invention are effected by known controlling devices which have been employed in an apparatus of this genre. For example, a single slip or a single set of slips of the continuous web of paper 1 may be counted by a counter to provide an output signal in response to which a control unit may be operative to take a timing with the above-mentioned counter and to furnish operating signals which may be applied to the various operating parts mentioned above.

An explanation will now be given with respect to an operation of the embodiment according to the present invention having the construction mentioned above.

The continuous web of paper 1, which has been printed and marked in a printing section and then formed with a series of cross or transverse perforations in a perforating section at predetermined intevals in the longitudinal direction, will now be drawn into the paper folding apparatus 2 by means of pull rollers 41 and 16.

In the paper folding apparatus 2, the continuous web of paper 1 will travels through the pull roller 41, the guide roller **43*a*, the compensation roller 42, the guide roller 43*b* and the pull roller 16 and then be passed through the paper cutting path 17 into the oscillatory shooter assembly 3 where, subjeted to an oscillatory swinging motion, it will be discharged from the nozzle roller 5 in a zigzag fashion, folded under the action of the pair of beaters 13, 13 onto the pair of screws 14, 14 and finally piled and transported on the conveyer 15**.

When the continuous web of paper 1 is passed through the compensation roller 42, a span thereof within the paper cutting path 17 will be adjusted so as to position the full edge type cutter 32 of the cutting cylinder 19 with respect to a given cross or transverse perforation on the continuous web paper 1.

Then, while the two cylinders 18 and 19 of the cuttng cylinder device 20 are rotated at a speed of rotation that is commensurate with a speed of travel of the continuous web of paper 1, it will be in a normal case that the operating cylinder 31 of this cutting cylinder device 20 is contractively operated to cause the cutting cylinder 19 to be eccentrically rotated.

This will cause the cutting cylinder 19 to be displaced away from the impression cylinder 18 and to be centered on the eccentric center $O_4$, while causing the full edge type cutter 32 shown in FIG. 6 to be displaced aslant downwards, thus leaving it outside of the paper cutting path 17.

Also, the continuous web of paper 1 traveling through the paper cutting path 17 will be guided by being passed between the wires **38*a* and 38*b* of the paper guiding device 37 that is provided between the two cylinders 18 and 19 of the cutting cylinder device 20**.

Also, the nozzle roller 5 will then be eccentrically positioned so as to be away from the counter roller 4, by virture of the fact that the operating cylinder 9 is contractively operated, and will thus be rotated while being apart from the counter roller 4 to an extent that it can lightly push the continuous web paper 1.

Accordingly, since the nozzle roller 5 is rotated at a speed of rotation that is faster than a speed of travel of the continuous web paper 1, the continuous web paper 1 then lying in the nozzle roller portion will then be discharged in a state in which it may be slightly pulled out while sliding through the nozzle roller portion. A slack of the continuous web of paper 1 as will be produced by the oscillatory motion will be absorbed by this nozzle roller 5.

Figure 9:
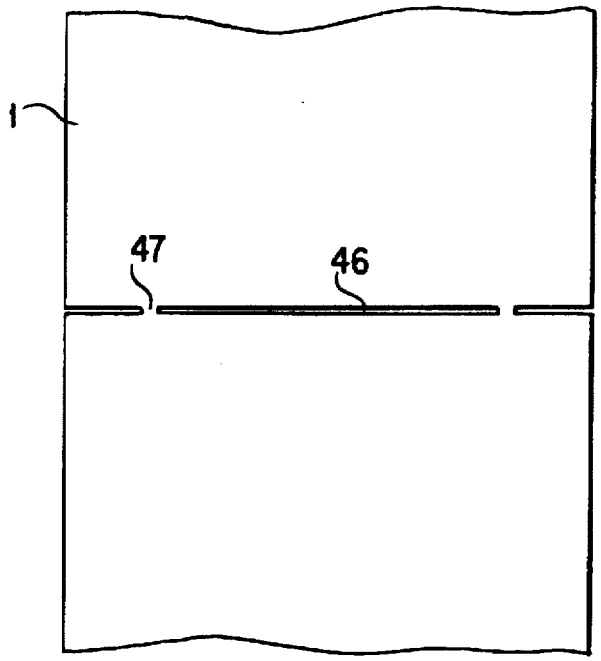
FIG. 9 is a front view illustrating a cross or transverse line of cuts that may be applied onto a continuous web of paper in the above-mentioned embodiment.

Under the conditions mentioned above, when a mark that has been applied on the continuous web of paper 1 is detected by the mark sensor 45, the operating cylinder 31 of the cutting cylinder device 20 will be expandingly operated, while taking a timing by means of the detected signal. When a predetermined cross perforation on the continuous web of paper 1 arrives at the position of the cutting cylinder device 20, the cutting cylinder 19 may be operated so as to be made eccentric in the direction in which it can approach the pressure cylinder 18 to allow the full edge type cutter 32 to be in contact with the above-mentioned cross perforation, whereby a cross line of cuts is applied onto and along this perforation. Such a cross line of cuts is shown in FIG. 9. It can be readily seen that a small uncut portion 47 is formed between cuts 46 which are applied by the full edge type cutter 32, and formed at a position which corresponds to a recess 35 formed in the full edge type cutter 32 on the cutting cylinder 19 as mentioned previously.

After the cutting cylinder 19 has finished the above-mentioned operation, the operating cylinder 31 will be contractively operated so that the cutting cylinder 19 may be eccentrically operated to be quickly away from the impression cylinder 18.

The above-mentioned cross line of cuts 46 interposed by small uncut portions 47 will, as it is, be passed through the guide rollers **39*b* and then entered into the oscillatory shooter assembly 3. When the cross line of cuts 46 arrives on the upstream side of and immediately before the nozzle roller 5, a timing will be taken to operate the operating cylinder 9 for the nozzle roller 5 expandingly so as to press the nozzle roller 5 against the counter roller 4**.

As a consequence, on the downstream side of the cross line of cuts 46, the continuous web of paper 1 will be pulled by the nozzle roller 5 which is rotated at a speed of rotation that is faster than a speed of travel of the continuous web of paper 1. This will cause the small uncut portions 47 among the cut portions 46 to be torn and thus the continuous web of paper 1 to be cut off at the cross line of cuts 46. Since the cut portion of the continuous web of paper 1, which is on the downstream side of the cross line of cuts 46, will be immediately held down by the beater 13 and the screw 14, it will be folded in order.

On the other hand, immediately after the above-mentioned cutting operation, the operating cylinder 9 will be quickly operated contractively so that the nozzle roller 5 may be eccentrically operated to release its pressing force against the counter roller 4. Accordingly, after the continuous web of paper 1 is cut off, the front end thereof, which is on the upstream side of the cross line of cuts 46, will be swingingly discharged from the nozzle roller 5, and then folded without any trouble.

Both cylinders 18 and 19 of the cutting cylinder device 20 in the above-mentioned embodiment according to the present invention are coupled to the driving shaft in the printing machine that may incorporate the paper folding apparatus 2. And, their speed of rotation is so adjusted that their peripheral speed may be identical with a speed of travel of the continuous web of paper 1. Further, by making the peripheral length of the cutting cylinder 19 identical with the distance between two adjacent cross perforations on the continuous web of paper 1, the full edge type cutter 32 can be synchronous with any cross or transverse perforation formed thereon. It will thus be seen that if the distance between two adjacent cross perforations is varied, the cutting cylinder 19 is correspondingly exchanged.

Figure 10:
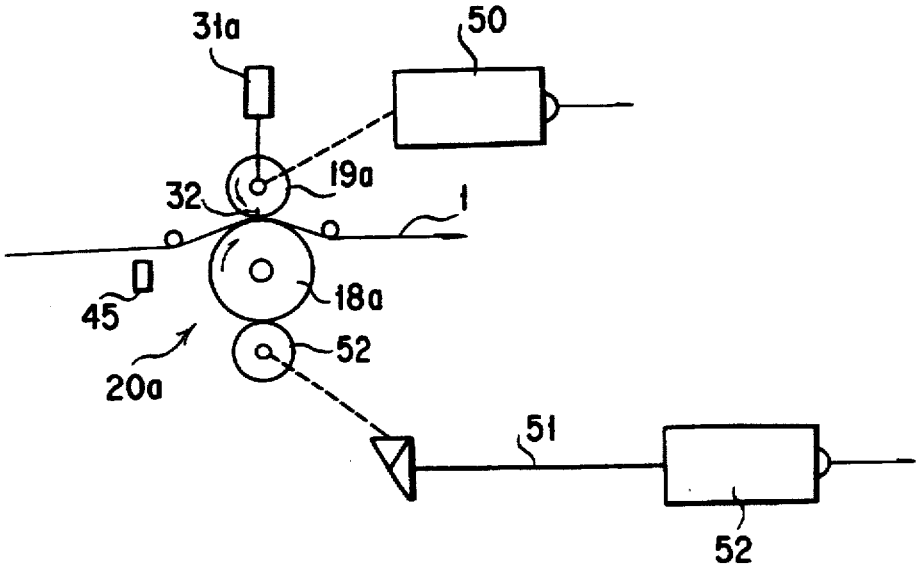
FIG. 10 is constructive view diagrammatically illustrating another embodiment according to the present invention.

FIG. 10 shows another embodiment according to the present invention. In the embodiment, a cutting cylinder 19*a* of a cutting cylinder device 20*a* is so constructed as to be driven by a servo motor 50 while the cutting cylinder 19*a* is adapted to be displaced towards and away from a impression cylinder 18*a* by means of an operating cylinder 31*a*.

Further, as will be seen, the above-mentioned impression cylinder 18*a* is coupled via a gear to a driving shaft 51 of the paper folding apparatus. And it is so rotated that its peripheral speed may be identical with a speed of travel of the continuous web of paper 1. On the other hand, the servo motor 50 for driving the cutting cylinder 19*a* is adapted to be controlled synchronously with a main shaft motor 52 so that, while a single pitch of cross perforations on the continuous web of paper 1 is displaced, a single rotation of the cutting cylinder 19*a* may be effected.

According to the above-mentioned another embodiment of the present invention, the phase of rotation of the cutting cylinder 19*a* with respect to the driving shaft 51 can be varied as desired by controlling the servo motor 50. Hence, even if there is changed the pitch of cross perforations on the continuous web paper, it is unnecessary to exchange the cutting cylinder 19*a*.

Further, after a mark on the continuous web paper 1 is detected by the mark sensor 45, the operating timing of the cutting cylinder 19*a* can be adjusted as desired by being converted into pulses in an encoder. Hence, a compensation roller will be then unnecessary.

Figure 11:
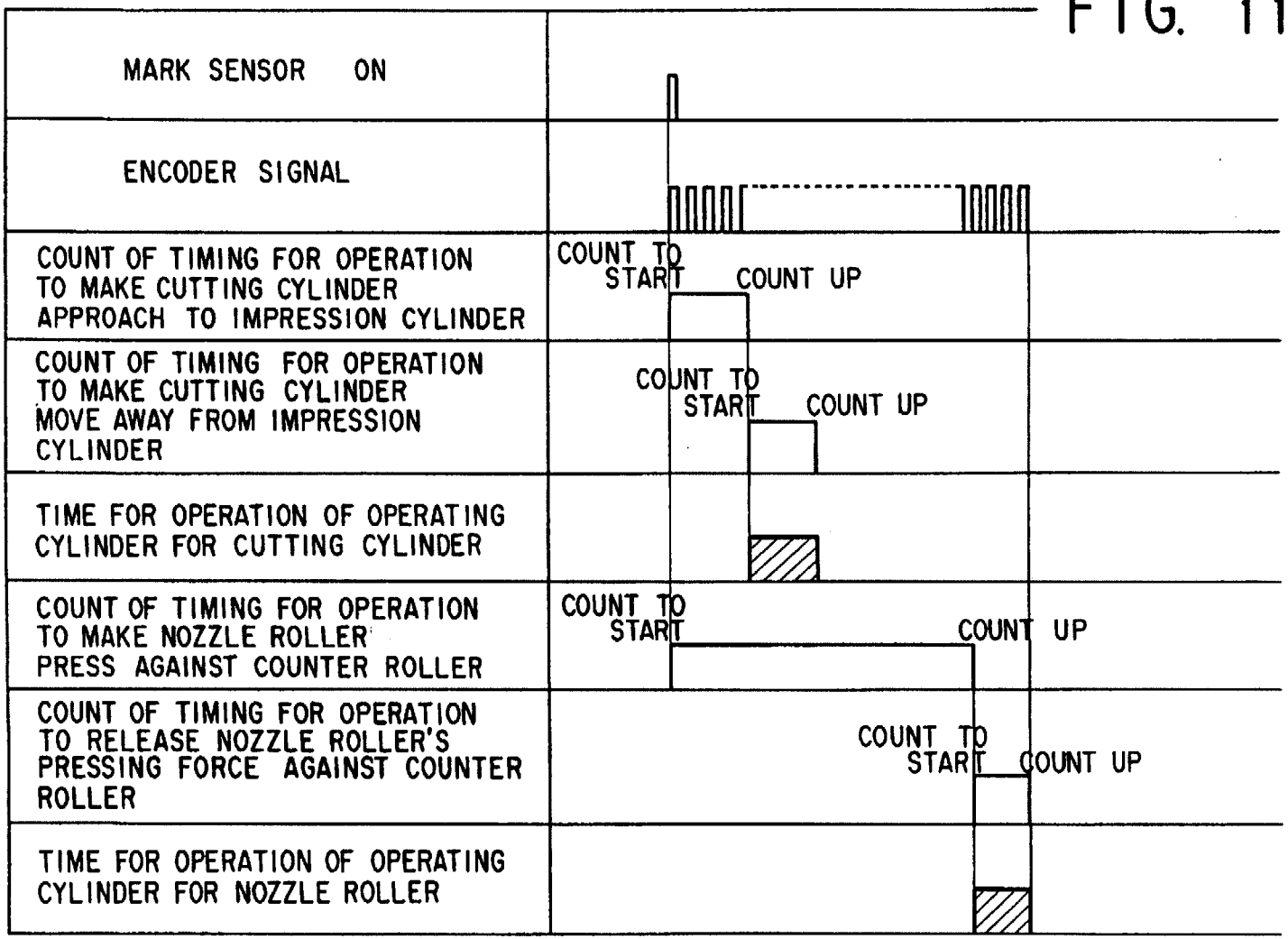
FIG. 11 is a timing chart diagrammatically illustrating a series of operational timing steps that may be implemented in both of the above-mentioned embodiments according to the present invention.

In both of the above-mentioned embodiments according to the present invention, FIG. 11 shows, first of all, the detection of a mark by means of the mark sensor 45 and then the occurrence of an encoder timing signal (a succession of pulses), the count of timing for the operation to make the cutting cylinder approach to the impression cylinder for forming a cross line of cuts 46 on the continuous web of paper along a given cross perforation, the count of timing for the operation to make the cutting cylinder move away from the impression cylinder, time for the operation of the operating cylinder for the cutting cylinder, the count of timing for the operation to make the nozzle roller press against the counter roller, the count of timing for the operation to release the nozzle roller's pressing force against the counter roller, and time for the operation of the operating cylinder for the nozzle roller.

As set forth in the foregoing, according to the present invention, in a paper folding apparatus for a form printing machine, there can be automatically cut a continuous web of paper which has traveled from the form printing machine at intervals of a predetermined length thereof, that is, at intervals of a predetermined number of folds of consecutive slips defined by successive cross perforations, in a manner such that a processing or handling operation after folding the continuous web of paper may be simplified, expedited and facilitated, thereby enhancing the productivity of the entire system.

Since the cutting of a continuous web of paper can be effected on the upstream side of and immediately before a nozzle roller which is rotated at a peripheral speed of rotation that is faster than a speed of travel of the continuous web of paper, there can be effectively eliminated a free end portion which is an upstream part of a cut portion of the continuous web of paper towards the oscillatory shooter assembly. Therefore, it is possible to prevent the occurrence of a jam in the upstream part of the cut portion of the continuous web paper when it is folded.

Further, according to the present invention, it will be seen that any traveling trouble of a continuous web of paper is eliminated also at the position where the cross line of cuts is applied to the continuous web of paper by means of a full edge type cutter because the continuous web of paper which travels here can be guided through the paper guiding device 37.

While the present invention has hereinbefore been described with respect to certain illustrative embodiments thereof, it will be readily appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A paper folding apparatus for a form printing machine, comprising:

a paper traveling path enabling a continuous web of paper to travel at a predetermined speed of travel, said continuous web paper having a plurality of cross perforations formed at preselected intervals by a perforating section;

an oscillatory shooter device having at one end thereof a nozzle roller and a counter roller rotating about respective axes, said nozzle roller rotating with a peripheral speed that is faster than the predetermined speed of travel of said continuous web paper, said oscillatory shooter device enabling said continuous web paper to be passed between both of the counter and nozzle rollers, said oscillatory shooter device being oscillatingly swung leftward and rightward so that said continuous web of paper is folded by an oscillatory motion of said oscillatory shooter device along said plurality of cross perforations in a zigzag pattern; and a paper cutting device comprising:

a cross-line cutting device for forming a cross line of cuts interposed by at least one small uncut portion in said continuous web paper, said cross line cutting device being disposed on an upstream side of said oscillatory shooter device; and a cutter operatively coupled to and disposed on said cross-line cutting device for cutting said continuous web paper;

wherein said oscillatory shooter device includes:

a support for supporting said nozzle roller such that said nozzle roller axis is displaceable toward and away from said counter roller axis and such that said nozzle roller axis is movable between a first position at which the nozzle roller is at least lightly pressed against said counter roller so as to enable said continuous web paper to slidably travel between the nozzle and counter rollers and a second position at which said nozzle roller engages against said counter roller such that said continuous web paper does not slide between said counter and nozzle rollers; and an operating means for moving said nozzle roller axis from said first position to said second position when said cross line of cuts is positioned immediately upstream of said nozzle roller.

2. The paper cutting device as defined by claim 1, further comprising a paper guiding assembly including first and second pairs of guide rollers respectively positioned on an upstream and downstream side of the cross-line cutting device, and a paper guiding device disposed between said first and second guide rollers and the oscillatory shooter device.

3. A paper folding apparatus for a form printing machine according to claim 1, wherein at least one of the nozzle roller and counter roller has a substantially circular cross section.

4. A paper folding apparatus for a form printing machine, according to claim 1, wherein the counter roller axis is fixed with respect to the oscillatory shooter device.

5. A paper folding apparatus for a form printing machine, comprising:

a paper traveling path enabling a continuous web of paper to travel at a predetermined speed of travel, said continuous web paper having a plurality of cross perforations formed at preselected intervals by a perforating section;

an oscillatory shooter device having at one end thereof a nozzle roller and a counter roller rotating about respective axes, said nozzle roller rotating with a peripheral speed that is faster than the predetermined speed of travel of said continuous web paper, said oscillatory shooter device enabling said continuous web paper to be passed between both of the counter and nozzle rollers, said oscillatory shooter device being oscillatingly swung leftward and rightward so that said continuous web of paper is folded by an oscillatory motion of said oscillatory shooter device along said plurality of cross perforations in a zigzag pattern; and a paper cutting device comprising:

a cross-line cutting device for forming a cross line of cuts interposed by at least one small uncut portion in said continuous web paper, said cross-line cutting device being disposed on an upstream side of said oscillatory shooter device; and a cutter operatively coupled to said cross-line cutting device for cutting said continuous web of paper;

wherein said cross-line cutting device includes a cutting cylinder which includes a full edge type cutting member that is slightly protruded and which forms the cross line of cuts interposed by at least one small uncut portion in said continuous web paper, said cutting cylinder being synchronously rotated with a speed of travel of said continuous web paper for forming said cross line of cuts in response to a signal depending upon a predetermined length of travel of said continuous web paper;

wherein said full edge type cutting member applies said cross line of cuts onto and along said cross perforation formed previously on said continuous web paper in said perforating section;

wherein said oscillatory shooter device includes a support for supporting said nozzle roller and an operating means for moving said nozzle roller;

wherein said support supports said nozzle roller such that said nozzle roller axis is displaceable toward and away from said counter roller axis and such that said nozzle roller axis is movable between a first position at which the nozzle roller is at least lightly pressed against said counter roller so as to enable said continuous web paper to slidably travel between the nozzle and counter rollers and a second position at which said nozzle roller engages against said counter roller such that said continuous web paper does not slide between said counter and nozzle rollers; and wherein said operating means moves said nozzle roller axis from said first position to said second position when said cross line of cuts is positioned immediately upstream of said nozzle roller.

6. The paper cutting device as defined by claim 5, further comprising a paper guiding assembly including first and second pairs of guide rollers respectively positioned on an upstream and downstream side of the cross-line cutting device, and a paper guiding device disposed between said first and second guide rollers and the oscillatory shooter device.

7. A paper folding apparatus for a form printing machine according to claim 5, wherein at least one of the nozzle roller and counter roller has a substantially circular cross section.

8. A paper folding apparatus for a form printing machine according to claim 5, wherein the counter roller axis is fixed with respect to the oscillatory shooter device.

9. A paper cutting method in a paper folding apparatus for a form printing machine, the method comprising the steps of:

providing, in said paper folding apparatus, a paper travel path for permitting a continuous web paper to travel at a selected speed of travel, said continuous web of paper having a plurality of cross perforations formed at predetermined intervals by a perforating section;

providing, in said paper folding apparatus, an oscillatory shooter device having at one end thereof a nozzle roller and a counter roller rotating about respective axes;

rotationally driving said nozzle roller with a peripheral speed that is faster than a speed of travel of said continuous web paper;

passing said continuous web paper between both the nozzle and counter rollers while the nozzle and counter rollers are oscillatingly swung leftward and rightward so that said continuous web paper is folded by an oscillatory motion of said oscillatory shooter device along the plurality of cross perforations in a zigzag pattern;

disposing, on an upstream side of said oscillatory shooter device, a cross-line cutting device for forming a cross line of cuts interposed by at least one small uncut portion in said continuous web paper;

disposing, on said cross-line cutting device, a cutter for cutting said continuous web paper;

disposing on said oscillatory shooter device, a support for supporting said nozzle roller and an operating means for moving said nozzle roller;

supporting said nozzle roller such that said nozzle roller axis is displaced either toward or away from said counter roller axis and such that said nozzle roller axis is moved between a first position wherein the nozzle roller is lightly pressed against said counter roller so as to enable said continuous web paper to slidingly travel between said nozzle and counter rollers and a second position wherein the nozzle roller engages the counter roller such that the continuous web paper does not slide between said nozzle and counter rollers; and moving said nozzle roller axis from said first position to said second position when said cross line of cuts is positioned immediately upstream and ahead of said nozzle roller, thereby cutting said continuous web paper along said cross line of cuts, and subsequent to the preceding step, performing an operation for moving said nozzle roller to said first position.

10. A paper cutting method in a paper folding apparatus for a form printing machine according to claim 9, wherein at least one of the nozzle roller and counter roller has a substantially circular cross section.

11. A paper cutting method in a paper folding apparatus according to claim 9, wherein the counter roller axis is fixed with respect to the oscillatory shooter device.

12. A paper cutting method in a paper folding apparatus for a form printing machine, the method comprising the steps of:

providing, in said paper folding apparatus, a paper travel path for permitting a continuous web paper to travel at a selected speed of travel, said continuous web paper having a plurality of cross perforations formed at predetermined intervals by a perforating section;

providing, in said paper folding apparatus, an oscillatory shooter device having at one end thereof a nozzle roller and a counter roller rotating about respective axes;

rotationally driving said nozzle roller with a peripheral speed that is faster than a speed of travel of said continuous web paper;

passing said continuous web paper between both the nozzle and counter rollers while the nozzle and counter rollers are oscillatingly swung leftwards and rightward so that said continuous web paper is folded by an oscillatory motion of said oscillatory shooter device along the plurality of cross perforations in a zigzag pattern;

disposing, on an upstream side of said oscillatory shooter device, a cross-line cutting device for forming a cross-line of cuts interposed by at least one small uncut portion in said continuous web paper;

disposing, on said oscillatory shooter device, a cutter for cutting said continuous web paper;

disposing, as said cross-line cutting device for forming the cross line of cuts, a cutting cylinder which is provided with a full edge type cutting member that is slightly protruded and is adapted to form said cross line of cuts interposed by at least one small uncut portion in said continuous web paper;

rotating said cutting cylinder synchronously with the selected speed of travel of said continuous web of paper;

automatically performing an operation for forming said cross line of cuts in response to a signal detected depending upon a predetermined length of travel of said continuous web of paper, said cross line of cuts being then applied onto and along said cross perforation formed previously on said continuous web of paper in said perforating section;

supporting said nozzle roller such that said nozzle roller axis may be displaced either toward or away from said counter roller axis and such that said nozzle roller axis is moved between a first position wherein the nozzle roller is lightly pressed against said counter roller so as to enable said continuous web paper to slidingly travel between said nozzle and counter rollers and a second position wherein the nozzle roller engages the counter roller such that the continuous web paper does not slide between said nozzle and counter rollers; and moving said nozzle roller axis from said first position to said second position when said cross line of cuts is positioned immediately upstream and ahead of said nozzle roller, thereby cutting said continuous web paper along said cross line of cuts, and subsequent to the preceding step, performing an operation for moving said nozzle roller to said first position.

13. A paper cutting method in a paper folding apparatus for a form printing machine according to claim 12, wherein at least one of the nozzle roller and counter roller has a substantially circular cross section.

14. A paper cutting method in a paper folding apparatus according to claim 12, wherein the counter roller axis is fixed with respect to the oscillatory shooter device.

* * * * *